US008273414B2

(12) United States Patent
Daniels et al.

(10) Patent No.: US 8,273,414 B2
(45) Date of Patent: Sep. 25, 2012

(54) PHOSPHATE-CONTAINING BINDERS FOR NONWOVEN GOODS

(75) Inventors: Christian Leonard Daniels, Fogelsville, PA (US); Ronald Joseph Pangrazi, Fleetwood, PA (US); Richard Henry Bott, Macungie, PA (US)

(73) Assignee: Wacker Chemical Corporation, Adrian, MI (US)

( * ) Notice: Subject to any disclaimer, the term of this patent is extended or adjusted under 35 U.S.C. 154(b) by 126 days.

(21) Appl. No.: 12/718,363

(22) Filed: Mar. 5, 2010

(65) Prior Publication Data

US 2010/0227072 A1 Sep. 9, 2010

Related U.S. Application Data

(60) Provisional application No. 61/157,673, filed on Mar. 5, 2009.

(51) Int. Cl.
*B05D 3/02* (2006.01)

(52) U.S. Cl. ..... 427/391; 162/111; 427/384

(58) Field of Classification Search ..... 162/111; 427/384, 391; 524/710
See application file for complete search history.

(56) References Cited

U.S. PATENT DOCUMENTS

| | | | | |
|---|---|---|---|---|
| 3,879,257 | A | 4/1975 | Gentile et al. | |
| 3,903,342 | A | 9/1975 | Roberts, Jr. | |
| 4,057,669 | A | 11/1977 | McConnell | |
| 4,449,978 | A * | 5/1984 | Iacoviello | 604/372 |
| 4,609,704 | A * | 9/1986 | Hausman et al. | 524/710 |
| 5,565,062 | A * | 10/1996 | Nass et al. | 162/168.1 |
| 5,674,590 | A | 10/1997 | Anderson et al. | |
| 5,776,306 | A | 7/1998 | Hepford | |
| 6,638,998 | B2 * | 10/2003 | Zhao et al. | 524/127 |
| 8,012,285 | B2 * | 9/2011 | Goldstein et al. | 156/183 |

FOREIGN PATENT DOCUMENTS

WO WO 02088260 11/2002

* cited by examiner

*Primary Examiner* — Fred M Teskin
*Assistant Examiner* — Marie Reddick
(74) *Attorney, Agent, or Firm* — RatnerPrestia

(57) ABSTRACT

A method of improving the wet tensile strength of a cellulose-containing web includes applying to the web an aqueous binder emulsion and subsequently drying and curing the binder emulsion. The aqueous binder emulsion is prepared by emulsion-polymerizing a monomer mixture comprising vinyl acetate, ethylene, and an olefinically unsaturated crosslinking monomer in the presence of a phosphate ester surfactant wherein the at least one crosslinking monomer comprises a (meth)acrylamide moiety and a cellulose-reactive moiety. The binder emulsion may be applied to a cellulose-containing web to increase wet strength, aid in creping, or both.

13 Claims, No Drawings

PHOSPHATE-CONTAINING BINDERS FOR NONWOVEN GOODS

CROSS REFERENCE TO RELATED APPLICATIONS

This application claims priority of U.S. Provisional Application No. 61/157,673, filed Mar. 5, 2009, the entirety of which is incorporated herein by reference.

BACKGROUND OF THE INVENTION

Vinyl acetate-ethylene copolymer emulsions have been widely used as binders for paints, adhesives, and as binders for nonwoven and woven goods, among other uses. Vinyl acetate-ethylene copolymer emulsions used for nonwoven goods generally contain a crosslinking comonomer in the copolymer, the crosslinking function being exercised after the emulsion is applied to a loosely assembled web of fibers. The crosslinking function serves to improve wet strength, dry strength, and solvent resistance in the goods. Many applications involve exposure of the finished substrate to water, and therefore binders providing good wet tensile strength are of continuing commercial interest.

SUMMARY OF THE INVENTION

The invention provides a method of improving the wet tensile strength of a cellulose-containing web. The method includes applying to the web an aqueous binder emulsion and subsequently drying and curing the binder emulsion, wherein the aqueous binder emulsion is prepared by emulsion polymerizing a monomer mixture including vinyl acetate, ethylene, and at least one crosslinking monomer. The polymerization is performed in the presence of at least one phosphate ester surfactant, and the at least one crosslinking monomer incorporates a (meth)acrylamide moiety and a cellulose-reactive moiety.

DETAILED DESCRIPTION OF THE INVENTION

The invention provides binder emulsions for improving the wet tensile strength of cellulose-containing nonwoven materials, and methods of making and using the compositions. The binder emulsions may be applied to nonwoven cellulose-containing webs, such as paper, to provide increased wet tensile strength, and thus they may be used for a variety of applications where this property is important. One example of suitable use includes paper towels, where good wet strength allows the towel to hold up well when used for scrubbing a surface. Another suitable use is for making baby wipes. Again, for this type of finished product, wet tensile strength is key to the final product performance requirements. Other application areas include products made via traditional nonwoven fiber lay down techniques such as card and bond, used to make interlinings and disposable articles ranging from fabric softener basesheet to kitchen surface wiping cloths. In some embodiments, the binder emulsions may be applied to paper webs prior to creping, and therefore also need to provide the necessary adhesion to the creping drum. An airlaid pulp process may be employed to make feminine hygiene cores that require good bulk retention for maximized absorbency, and for such applications the binder may need excellent stability to withstand the shear associated with fine droplet size formation during spraying.

Binder emulsions according to the invention comprise emulsion copolymer latexes prepared from vinyl acetate, ethylene, and an olefinically unsaturated crosslinking monomer, formed in the presence of a phosphate ester surfactant and optionally one or more other surfactants. Optionally, additional olefinically unsaturated monomers may also be included. These may include olefinically unsaturated polymerizable sulfonic acids such as 2-acrylamido-2-methylpropane sulfonic acid (AMPS) or sodium vinyl sulfonate, although others may be used instead or in addition. In some embodiments, sodium styrene sulfonate may be used. Other exemplary additional monomers include unsaturated carboxylic acids such as acrylic, methacrylic, crotonic, itaconic, and maleic acid. Other additional monomers may include, but are not limited to, diacrylates, vinyl esters of $C_{2-10}$ alcohols, acrylonitrile, styrene, butadiene, and $C_{1-8}$ alkyl esters of acrylic and methacrylic acid such as methyl (meth)acrylate, ethyl(meth)acrylate, butyl(meth)acrylate, hexyl(meth)acrylate, and 2-ethylhexyl(meth)acrylate. The additional olefinically unsaturated monomers are optional, however, and any or all of them may be absent in copolymer latexes according to the invention. In some embodiments of the invention, the copolymer does not contain units derived from fluorinated monomers, and in some embodiments it does not contain units derived from chlorinated monomers. In some embodiments, monomers having amine or ammonium functionality are not included. Other extraneous materials such as pigments are typically excluded from the binder emulsions and substrates treated with them.

The binder emulsions of the invention have good stability, and it is not necessary and indeed sometimes undesirable to include protective colloids when forming the emulsions, although their inclusion may be of value in certain circumstances depending on the balance of properties desired for a particular application. Examples of such materials that may be omitted during the polymerization include starch and modified starches, hydroxyalkyl celluloses, polyvinyl alcohol, polyvinyl pyrrolidone and polyvinyl pyridine.

The binder emulsions are designed to provide treated webs with good wet strength and creping properties without the need to include polyvalent metal cations, as required by some conventional binder emulsions. Thus, inclusion of metals such as zirconium, zinc, vanadium, titanium, magnesium, calcium and aluminum is typically avoided both in the binder emulsion and in its use in treating a substrate. While some amounts of these metals may be present as impurities (e.g., due to water hardness) in the binder emulsions of the invention, they are not added as ingredient to the formulations and are not present in an amount effective to crosslink or otherwise substantially affect the activity of the binders. Levels of polyvalent metals in the binder emulsions are typically very low, and usually below 0.1 wt % or 0.05 wt % or 0.02 wt %, based on emulsion nonvolatiles.

In some embodiments of the invention, the copolymer comprises (in polymerized form) 50 to 90 wt % (typically 70 to 85 wt %) vinyl acetate, 5 to 44 wt % (typically 10 to 30 wt %) ethylene, and 1 to 10 wt % (typically 3 to 8 wt %) in total of one or more crosslinking monomers, based on the total weight of the copolymer. A 3-6 wt % level of crosslinking monomer is most common. Typically, units of vinyl acetate, ethylene, and the at least one crosslinking monomer constitute at least 90 wt % of the copolymer. Olefinically unsaturated polymerizable sulfonic or carboxylic acids, if included, will typically be present in a range from 0.1 wt % to 2 wt %, more typically from 0.3 wt % to 1 wt %.

Crosslinking Monomers

The term "crosslinking monomer" as used herein means a monomer having a polymerizable olefinic group and one or more cellulose-reactive moieties. Exemplary cellulose-reactive moieties include N-methylol, aldehyde, protected N-methylol, protected aldehyde, and glycolic acid moieties. In some embodiments of the invention, the crosslinking monomer is free of epoxy or isocyanate moieties. Typically, there is only one polymerizable olefinic group in the crosslinking monomer, although there may be more. In many embodiments a (meth)acrylamide structure provides the polymerizable olefinic group, and typically it is the only polymerizable olefinic group in the crosslinking monomer although others may be used in addition or instead. Examples of crosslinking monomers include i-butoxy methylacrylamide, acrylamidoglycolic acid, acrylamidobutyraldehyde, dialkyl acetals of acrylamidobutyraldehyde in which the alkyl groups each individually have 1 to 4 carbon atoms, and N—($C_{1-4}$) alkylol (meth)acrylamides such as N-methylol acrylamide. Any of the crosslinking monomers can be used alone, together, or in combination with acrylamide, although in many embodiments no acrylamide is included. Typically, the crosslinking monomer will comprise N-methylol acrylamide. When the copolymer emulsion is applied to a nonwoven web and dried at elevated temperatures, the copolymer cures and imparts wet strength to the substrate.

Surfactants

Emulsion polymerization of the above-mentioned monomers is performed in the presence of at least one phosphate ester surfactant and optionally one or more other surfactants. A variety of phosphate ester surfactants are suitable for use according to the invention. Typical examples include phosphate esters of ethoxylate surfactants, i.e., surfactants having ethylene oxide repeat units. The Examples shown later herein use a phosphate ester of a tridecyl alcohol ethoxylate having 6 moles of ethylene oxide. The invention, however, is not limited to these esters and other phosphate esters may be used in similar fashion.

Examples of specific suitable phosphate ester surfactants are described in published PCT patent application WO02/088260, incorporated herein by reference. Phosphate ester surfactants of this type include compounds having the following structure:

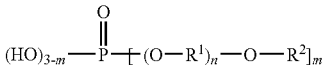

wherein m is 1 or 2, n is an integer from 1 to 100, $R^1$ is $C_1$-$C_5$ alkyl, O—$R^2$ is an alkylphenol residue wherein $R^2$ has the structure $C_6H_4$—$C_pH_{2p+1}$ or O—$R^2$ is a linear or branched alkyl alcohol residue wherein $R^2$ has the structure $C_pH_{2p+1}$, and p is an integer from 1 to 30.

The number of ethylene oxide repeat units will typically be in a range of 4-10, but other values may also be suitable depending upon the particular needs of the system. Phosphate esters of other alcohols using different hydrophobic portions may also be used instead or in addition, including but not limited to esters of nonyl phenol ethoxylates, octyl phenol ethoxylates, and various natural and synthetic alcohol ethoxylates. The corresponding salts of any of these phosphate esters may also be used, including but not limited to ammonium, sodium and potassium salts. The phosphate esters may be mono-esters, diesters, or combinations of these, and the ratio of mono-ester to diester may be varied according to the specific needs of a given situation. Mono-esters prepared from alcohols comprising mixtures of hydrophobes and/or ethoxylate levels may be used, and diesters prepared from such mixtures may also be used.

Other surfactants may also be included in the emulsions, for example nonionic surfactants such as ethylene oxide/propylene oxide block copolymers, available from BASF under the trade name PLURONIC®. Other examples include secondary alcohol ethoxylates such as 2-pentadecanol ethoxylate, containing 7 to 30 ethylene oxide (EO) repeat units, typically 12 to 20 EO repeat units, or an ethoxylated branched primary alcohol, such as tridecanol ethoxylate, containing 3 to 30 EO units, typically 9 to 20 units. The primary or secondary alcohol can contain 7 to 18, typically 9 to 14 carbon atoms. An example of an appropriate nonionic surfactant is TERGITOL™ 15-S-20 surfactant (a secondary alcohol ethoxylate containing 20 EO units), supplied by Dow as an 80% aqueous solution. Also useful in some embodiments are ethoxylated adducts of naturally occurring alcohols such as oleyl or lauryl. The amount of phosphate ester surfactant, based on the combined olefinically unsaturated components in the copolymer, will typically be in a range of 0.1 to 4 wt % (more typically 0.5 to 2 wt %). The amount of other surfactant, if present, will typically be in a range from 0.5 to 5 wt % (more typically 1 to 4 wt %). It is not necessary to include a sulfate-based anionic surfactant (e.g., sodium laureth sulfate, etc.) in the binder emulsion, and in some embodiments it is preferred that such surfactants not be included.

Binder Emulsion Preparation

The emulsion polymerization may be conducted in a staged or sequential manner and can be initiated by thermal initiators or by a redox system. The amount of thermal initiator used in the process is 0.1 to 3 wt %, typically more than about 0.5 wt %, based on total monomers. Thermal initiators are well known in the emulsion polymer art and include, for example, ammonium persulfate, sodium persulfate, and the like. Alternatively, any suitable redox system known in the art can be used. For example, the reducing agent can be a bisulfite, a sulfoxylate, ascorbic acid, erythorbic acid, or the like. Examples of oxidizing agent are hydrogen peroxide, persulfates, and organic peroxides such as tert-butyl peroxide or tert-butyl hydroperoxide. The combined amount of oxidizing and reducing agent in the redox system is typically about 0.1 to 4 wt %.

Effective emulsion polymerization reaction temperatures range from about 30 to 120° C. and typically 45° C. to 90° C., depending on whether the initiator is a thermal or a redox initiator.

Application of the Binder Emulsions

Binder emulsions according to the invention are useful for improving wet strength of nonwoven webs containing wood pulp or cellulose fibers. The amount of binder applied to the web can vary over a wide range, and may for example constitute at least about 2 wt % and more typically at least about 6 wt % of the finished product. Typically it constitutes at most 30 wt %, and more typically at most 20 wt %. When the products are paper-based wiper products, it is generally desirable to keep the amount of binder to a minimum.

The viscosity of the copolymer emulsion may be adjusted according to the method by which it is applied to the substrate. For a typical application by gravure printing, the viscosity will typically be in a range of 5 to 80 cps and a nonvolatiles level of about 30%, and is preferably capable of being thickened to about 100 cps with hydroxyethyl cellulose and/or other thickener(s). If the emulsion is to be applied by spraying or by saturating a substrate, the viscosity will typically be less with formulated viscosity commonly below 30 cps. Viscosity is measured using a Brookfield Model LVT viscometer at 60 rpm. The emulsion copolymers of this invention produce a minimal amount of foam when the emulsions are pumped and when mixed and recirculated when used as a nonwoven binder.

Upon drying the emulsion-treated web, the copolymer cures and imparts wet strength to the web. Curing is typically effected by heating the web at a temperature in a range from 250° F. to 300° F. for a period of time ranging from 1 to 30 seconds. Exact cure times and temperatures are dependent on numerous factors, including amount and type of catalyst and amount and type of crosslinking monomer.

One particularly useful application of the binder emulsions is as a creping aid for nonwoven webs. Typical nonwoven webs for creping comprise wood pulp (alone or blended with natural or synthetic fibers) processed by a dry process (e.g., air-laid, carded, or RANDO®) or by a wet-laid process.

Crepe processes, especially double recrepe (DRC) processes, can be used to produce paper products, such as paper towels and wipes, with specific properties. The DRC process involves creping a base sheet or nonwoven web on a drum, printing a polymeric binder on one side of the sheet, flash drying the binder, creping the base sheet on a drum again, printing a polymeric binder on the other side of the base sheet, flash drying the binder, and then creping the base sheet a third time. The base sheet is printed while traveling through gravure nip rolls. Various crepe processes and binding materials used in the processes are known, and can be used with the binder emulsions of this invention. Examples of such processes are disclosed in U.S. Pat. No. 3,879,257, U.S. Pat. No. 3,903,342, U.S. Pat. No. 4,057,669, U.S. Pat. No. 5,674,590 and U.S. Pat. No. 5,776,306, all of which are incorporated herein by reference.

EXAMPLES

All copolymers were prepared in a 1.05 gallon stainless steel autoclave equipped with a jacket for cooling, a mechanical turbine agitator, and metering pumps for addition of the various feeds. Deionized water was used for all preparations. The Examples describe application of the binder emulsions to creped tissue, but it is expected that in commercial practice the binders will in many cases be applied prior to and/or during creping. In such cases, the binder emulsion may be applied as a saturant, for example as about a 20% nonvolatiles emulsion.

Example 1

An autoclave was charged with 950 g of water, 19.2 g of RHODAFAC® RS-610 SURFACTANT (phosphate ester of a tridecyl alcohol ethoxylate, having a mono/di ester ratio ~1.2/1, supplied by Rhodia), 35.8 g of PLURONIC® L-64 SURFACTANT (ethylene oxide/propylene oxide block copolymer supplied by BASF), 5.0 g of a 1% solution of ferrous ammonium sulfate. The pH of the charge was adjusted to 4.5 with 6.74 g of 7% ammonium hydroxide. Agitation was begun and 298 g of vinyl acetate was charged.

After the initial charging, the reactor was purged with nitrogen followed by a purge with ethylene and heated under agitation to 55° C., then 300 g of ethylene was charged. When the temperature and pressure had stabilized, 15 g of a 6.5% sodium formaldehyde sulfoxylate solution was added about 1 g/min. To initiate polymerization, a solution of 10% ammonium persulfate and 5% sodium bicarbonate was fed at 0.5 g/min. In addition, the 6.5% sodium formaldehyde sulfoxylate solution was also feed at 0.5 g/min. Upon evidence of an exotherm (about 5 minutes after beginning the persulfate feed), addition of a two monomer feeds was begun: 1194 g of vinyl acetate was added over 120 minutes and a second feed consisting of 101.1 g water, 187 g of 48% N-methylol acrylamide, and 17.9 g of Lubrizol 2403 (50% solution of the sodium salt of 2-acrylamido-2-methylpropane sulfonic acid, supplied by Lubrizol) was fed uniformly over 2.5 hours. When the monomer feeds were begun, the temperature was ramped from 55° C. to 85° C. over 30 minutes and then held at 85° C. for the remainder of the reaction.

The addition rates of the ammonium persulfate and sodium formaldehyde sulfoxylate were adjusted over time in an effort to obtain a uniform conversion profile. Both of these additions were terminated 3 hours after the initial exotherm was observed, when 165 g of each solution had been added (not including the initial 15 g of the sodium formaldehyde sulfoxylate solution).

The contents were then cooled to 35° C. then transferred to a 3-gallon autoclave where vacuum was used to remove any unreacted ethylene. At this point 2 g of RHODOLINE® 675 (a proprietary defoamer composition supplied by Rhodia) was added to reduce foaming, followed by 2 g of sodium formaldehyde sulfoxylate in 20 g of water, then 2 g of tert-butyl hydroperoxide (70%) in 10 g of water. The contents were allowed to mix for 15 minutes and were then removed.

The physical properties of the resultant latex were:

| | |
|---|---|
| % non-volatile | 53.7 |
| Tg | 6.2° C. |
| Viscosity | 119 cps (Brookfield LVF viscometer 60 rpm) |
| pH | 4.16 |
| coagulum | <.01% (100 mesh screen) |

Example 2

The recipe and procedure of Example 1 was followed except PLURONIC® L-64 SURFACTANT was replaced by 27.4 g of RHODASURF® ON-877 (a 70% solution of ethoxylated oleyl alcohol, supplied by Rhodia). The amount of 7% ammonium hydroxide required to adjust the pH of the initial charge was 6.34 g.

As in Example 1, the addition rates of the ammonium persulfate and sodium formaldehyde sulfoxylate were adjusted over time in an effort to obtain a uniform conversion profile. Both of these additions were terminated 3 hours after the initial exotherm was observed, when 201 g of each solution had been added (not including the initial 15 g of the sodium formaldehyde sulfoxylate solution).

The physical properties of the resultant latex were:

| | |
|---|---|
| % non-volatile | 52.7 |
| Tg | 6.5° C. |
| Viscosity | 68 cps (Brookfield LVF viscometer 60 rpm) |
| pH | 4.01 |
| coagulum | <.01% (100 mesh screen) |

Example 3

The recipe and procedure of Example 1 was followed except PLURONIC® L-64 SURFACTANT was replaced by 76.3 g of RHODASURF® ON-877 (a 70% solution of ethoxylated oleyl alcohol, supplied by Rhodia). The amount of 7% ammonium hydroxide required to adjust the pH of the initial charge was 6.55 g.

As in Example 1, the addition rates of the ammonium persulfate and sodium formaldehyde sulfoxylate were adjusted over time in an effort to obtain a uniform conversion profile. Both of these additions were terminated 3 hours after the initial exotherm was observed, when 245 g of each solution had been added (not including the initial 15 g of the sodium formaldehyde sulfoxylate solution).

The physical properties of the resultant latex were:

| | |
|---|---|
| % non-volatile | 51.8 |
| Tg | 5.0° C. |
| Viscosity | 79 cps (Brookfield LVF viscometer 60 rpm) |
| pH | 3.82 |
| coagulum | <.01% (100 mesh screen) |

For all of the Examples, % nonvolatiles was measured using an oven solids test. The resultant copolymer dispersions were then evaluated versus VINNAPAS® EN1165, a binder emulsion commercially available from Wacker Chemical Corporation of Allentown, Pa.

Application of the Binder Emulsion

In the Examples, the dispersion selected for evaluation is formulated before application to the appropriate substrate. The formulations for this work include water added to dilute the dispersion as needed to provide the desired loading level on the treated web. Also included are a catalyst, wetting agent, thickener, and a small amount of defoamer. In the Examples shown here, the catalyst is added at a level of 1% based on the nonvolatiles of the binder to help initiate self crosslinking of the polymeric binder on the sheet. Ammonium chloride is used in the Examples, but other catalysts can be used instead or in addition. Other examples include citric acid, sodium bisulfate, phosphoric acid, or other proton donors commonly used in producing nonwoven products. The wetting agent ensures proper wet-out of the emulsion on the fibers. Aerosol OT (a common wetting surfactant based on dioctyl sodium sulfosuccinate) is used in the present Examples, but other wetting agents may be used. A thickener (hydroxyethyl cellulose at 0.75 g/100 g binder on a solids/solids basis) is added to ensure proper printing of the formulation onto the substrate, and a very small amount of an oil based defoamer is added to prevent entrainment of air into the formulation. The ingredients of this formulation are added slowly under agitation and finally allowed to mix thoroughly. This final formulation is then added to the feed pan of the applicator.

In the Examples, a Geiger printing press is used to apply the binder emulsion. A piece of substrate 3½"×16" is adhered to a paperboard backing to provide stiffness to the substrate to allow for proper printing. The substrate is an unbonded heavy weight (46 gsm basis weight) creped tissue stock. The formulation is transferred to a chrome gravure roll bearing a diamond pattern engraved into the roll at a depth of 70 microns. Excess formulation is removed via a doctor blade. The substrate is fed through a roll system and the formulation is printed onto one side of the substrate. The printed substrate is removed from the paperboard backing and placed in a Precision oven set at 150° F. for one minute. The dried substrate is removed from the drying oven, flipped over and reattached to the backing paperboard carrier. The second side is printed similarly and the treated substrate is placed in a Mathis lab dryer for final drying and curing. This oven is set at 320° F. and the time allotted is dependent on cure profile but does not exceed three minutes.

The example used here is illustrative of application of the binder emulsion by a printing method, but those skilled in the art will be aware of other application methods and choose a method suited to the particular purpose at hand. For example, lab-scale saturation equipment may be used to emulate the industrial process of saturation. A Hobart lab foamer can be used when the commercial application step includes foaming, and a laboratory spray cabinet can be used for finished products that are typically sprayed, such as feminine hygiene articles or filtration substrates where the retention of bulk is desired.

Wet and Dry Tensile Strength Determination

The bonded substrate is die cut using a 1"×6" die cutter to prepare samples for tensile strength determination. The strips are placed in the jaws of an Instron mechanical tensile tester. For dry tensile determination the die cut samples are placed vertically into the jaws of the tester and the test is initiated. The tensile tester provides the statistics of the maximum tensile achieved at break. A cross head speed of 6"/minute is used and a gauge length of 4" is set for dry tensile determination. A number of tests are performed with the average calculated and reported. Wet tensile measurement is determined similarly except that the sample is placed into a Finch Cup apparatus that includes a water-filled reservoir. The sample is looped around a metal bar and then dipped into the water and held there for 15 seconds. The tensile test is then initiated. A gauge length of 2" is used due to the loop effect of the tensile strip. The maximum wet strength is determined by the tensile tester. Several tests are performed and the average is calculated.

A control sample was made according to the above procedure in which a commercially available emulsion binder (VINNAPAS® EN1165, available from Wacker Chemical Corporation of Allentown, Pa.) was used instead of the binders of this invention. Tensile results for sheets made with the formulations of Examples 1-3 and the commercial binder are shown below, reported as percent of control. The results are averages obtained from sheets cured for three minutes at 320° F., reported as percent of control. As can be seen, significant increases in both wet and dry tensile strength were obtained by using binder emulsions according to the invention, compared with a commercially available control binder.

| | Dry Tensile | Wet Tensile |
|---|---|---|
| Example 1 | 134% | 132% |
| Example 2 | 125% | 132% |
| Example 3 | 118% | 119% |
| VINNAPAS ® EN1165 | 100% | 100% |

Although the invention is illustrated and described herein with reference to specific embodiments, the invention is not intended to be limited to the details shown. Rather, various modifications may be made in the details within the scope and range of equivalents of the claims without departing from the invention.

What is claimed:

1. A method of improving the wet tensile strength of a cellulose-containing web, comprising applying to the web a pigment-free aqueous binder emulsion and subsequently drying and curing the binder emulsion;

wherein the aqueous binder emulsion is prepared by emulsion polymerizing a monomer mixture comprising vinyl acetate, ethylene, and at least one crosslinking monomer, the polymerization being performed in the presence of at least one phosphate ester surfactant; and wherein the at least one crosslinking monomer comprises a (meth)acrylamide moiety and a cellulose-reactive moiety.

2. The method of claim 1, wherein the at least one phosphate ester surfactant includes a surfactant having the following structure:

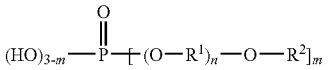

wherein m is 1 or 2, n is an integer from 1 to 100, $R^1$ is $C_1$-$C_5$ alkyl, O—$R^2$ is an alkylphenol residue wherein $R^2$ has the structure $C_6H_4$—$C_pH_{2p+1}$ or O—$R^2$ is a linear or branched alkyl alcohol residue wherein $R^2$ has the structure $C_pH_{2p+1}$, and p is an integer from 1 to 30.

3. The method of claim 1, wherein the at least one phosphate ester surfactant includes a phosphate ester of a tridecyl alcohol ethoxylate.

4. The method of claim 1, wherein the monomer mixture further includes at least one olefinically unsaturated polymerizable sulfonic acid.

5. The method of claim 1, wherein the monomer mixture further includes 2-acrylamido-2-methylpropane sulfonic acid.

6. The method of claim 1, wherein the monomer mixture further includes at least one olefinically unsaturated polymerizable carboxylic acid.

7. The method of claim 1, wherein the monomer mixture further includes acrylic acid.

8. The method of claim 1, wherein the at least one crosslinking monomer includes at least one member selected from the group consisting of i-butoxy methylacrylamide, acrylamidoglycolic acid, acrylamidobutyraldehyde, and dialkyl acetals of acrylamidobutyraldehyde in which the alkyl groups each individually have 1 to 4 carbon atoms.

9. The method of claim 1, wherein the at least one crosslinking monomer includes at least one N—($C_{1-4}$) alkylol (meth)acrylamide.

10. The method of claim 1, wherein the at least one crosslinking monomer includes N-methylol acrylamide.

11. The method of claim 1, wherein units of vinyl acetate, ethylene, and the at least one crosslinking monomer constitute at least 90 wt % of the copolymer.

12. The method of claim 1, wherein the web is a paper web.

13. The method of claim 1, further comprising creping the web.

* * * * *